US005590534A

United States Patent [19]

Benschop

[11] Patent Number: 5,590,534

[45] Date of Patent: Jan. 7, 1997

[54] STIRLING COOLER

[75] Inventor: Antonius A. J. Benschop, Waalre, Netherlands

[73] Assignee: Hollandse Signaalapparaten B.V., Hengelo, Netherlands

[21] Appl. No.: 503,473

[22] Filed: Jul. 18, 1995

[30] Foreign Application Priority Data

Aug. 1, 1994 [NL] Netherlands ..... 9401251

[51] Int. Cl.[6] ..... F25B 9/00

[52] U.S. Cl. ..... 62/6; 60/520

[58] Field of Search ..... 62/6; 60/520

[56] References Cited

U.S. PATENT DOCUMENTS

| | | | |
|---|---|---|---|
| 2,590,519 | 3/1952 | Du Pré | 62/6 |
| 2,906,101 | 9/1959 | McMahon et al. | 62/6 |
| 3,802,211 | 4/1974 | Bamberg et al. . | |
| 3,877,239 | 4/1975 | Leo | 62/6 |
| 4,019,335 | 4/1977 | Browning | 62/6 |
| 4,060,996 | 12/1977 | Hanson . | |
| 4,397,155 | 8/1983 | Davey | 62/6 |
| 4,425,764 | 1/1984 | Lam . | |
| 4,574,591 | 3/1986 | Bertsch | 62/6 |
| 4,796,430 | 1/1989 | Malaker et al. | 62/6 |
| 4,846,861 | 7/1989 | Berry et al. | 62/6 |
| 5,090,206 | 2/1992 | Strasser | 62/6 |
| 5,417,071 | 5/1995 | Inaguchi | 62/6 |

FOREIGN PATENT DOCUMENTS

| | | |
|---|---|---|
| 0437678A2 | 7/1991 | European Pat. Off. . |
| 0437661A1 | 7/1991 | European Pat. Off. . |
| 0576202A1 | 12/1993 | European Pat. Off. . |
| 4142368A1 | 7/1992 | Germany . |
| 1314107 | 4/1973 | United Kingdom . |
| WO93/11401 | 6/1993 | WIPO . |

*Primary Examiner*—Christopher Kilner
*Attorney, Agent, or Firm*—Oblon, Spivak, McClelland, Maier & Neustadt, P.C.

[57] ABSTRACT

The invention relates to a Stirling cooler, comprising a compressor for generating a time-varying pressure in a gaseous medium, a cooling element provided with at least a displacer and at least a regenerator and additionally comprising a connecting line between the compressor and the cooling element. The incorporation of heat flow-reduction means for reducing the heat flow from the compressor to the cooling element causes a sharp drop in temperature on the warm side of the cooling element as a result of which heat sinking will no longer be required.

5 Claims, 3 Drawing Sheets

STIRLING COOLER

BACKGROUND OF THE INVENTION

The invention relates to a Stirling cooler, comprising a compressor for generating a time-varying pressure in a gaseous medium, a cooling element provided with at least a displacer and at least a regenerator and additionally comprising a connecting line between the compressor and the cooling element.

Stirling coolers of this type are well-known and are mostly used for generating extremely low temperatures, in the order of 80 K, for instance for cooling optical sensors incorporated in infrared cameras. The advantage of inserting a connecting line between compressor and cooling element is that it provides maximum flexibility in the design of the system that is to accommodate the Stirling cooler. This enables the compressor to be mounted at a distance of the object to be cooled. The compressor is usually quite sizeable in comparison with the cooling element which may include a so-called cold finger. The connecting line, the length of which may vary from a few centimeters to several decimeters, enables the cooling element to be mounted at a certain distance from and at a random position with respect to the compressor.

The connecting line also goes by the name of split tube. The split tube mostly has a diameter ranging from less than one to several millimeters. A cooling medium, for instance Helium, is alternately compressed and expanded at a high frequency of for instance 50 Hz. The consequent periodically fluctuating pressure in the system is transmitted via the split tube to the cooling element. A cooling element implemented as a cold finger usually comprises a cylindrical cavity containing a displacer, which may also serve as a regenerator. The split tube is usually connected to the cooling element at the base of the displacer. To ensure the cooler's operational effectiveness, the displacer motion shall be tuned to the pressure fluctuations. To this end, the displacer motion shall preferably be 90° out of phase with the pressure. To achieve this, the displacer can be spring-mounted such that it will perform a reciprocating motion caused by the flow of cooling medium along the displacer, which yields a phase lag of approximately 90° with respect to the pressure fluctuation. The fluctuating pressure and the displacer motion give rise to a difference in temperature between the top and base of the displacer, which phenomenon is known from thermodynamics. Because of this temperature difference, reference is also often made to the warm side and the cold side of the cooling element, representing its base and top respectively.

A drawback attached to these types of Stirling coolers provided with a split tube is that the warm side of the cooling element is additionally heated as a result of heat conveyed via the split tube from the compressor to the cooling element. The temperature increase may assume such proportions that the required cooling power is no longer realized thus resulting in a rise of temperature on the cold side of the cooling element.

SUMMARY OF THE INVENTION

The Stirling cooler according to the invention obviates this drawback and is characterized in that heat flow-reduction means have been provided for reducing the heat flow from the compressor to the cooling element.

This advantageously causes a sharp drop in temperature on the warm side of the cooling element, as a result of which the incorporation of a heat sink at the warm end of the cooling element is no longer a strict requirement.

An advantageous embodiment is characterized in that the heat flow-reduction means are incorporated in the connecting line between the compressor and the cooling element. This entails the advantage that the heat flow-reduction means can conveniently be applied by inserting an additional section in the connecting line.

A further favourable embodiment is characterized in that the heat flow-reduction means are at least substantially mounted at the end of the connecting line, in the proximity of the cooling element. This has the advantage that, beyond the heat flow-reduction means, it is virtually impossible for the cooling medium to gain heat between the heat flow-reduction means and the cooling element.

A favourable embodiment is characterized in that the heat flow-reduction means comprise a heat sink mounted to the connecting line. This simply and effectively dissipates the heat even before it reaches the cooling element.

A further favourable embodiment is characterized in that the heat flow-reduction means comprise at least one additional regenerator positioned before the displacer.

The at least one additional regenerator absorbs heat during the compression stroke and dissipates this heat during the expansion stroke of the medium. This consequently causes a sharp temperature drop in the at least one additional regenerator. The temperature at the compressor side of the additional regenerator will rise and will prevent the conveyance of heat through the connecting line. This causes the temperature at the warm side of the cold finger to assume an acceptable level.

A further favourable embodiment is characterized in that at least one of the at least one additional regenerator is mounted in an enlargement of the connecting line. At a constant regenerator volume, this will cause a reduction of the flow resistance prevailing at the regenerator, which resistance is increased by the presence of the regenerator.

A further favourable embodiment is characterized in that at least one of the at least one additional regenerator is fitted in the warm side of the cooling element. This entails the advantage that the cooling element and additional regenerator can be constructed as one unit and that it prevents the medium from heating up as a result of the transfer through the remaining split tube section beyond the additional regenerator.

A further favourable embodiment is characterized in that at least one of the at least one additional regenerator comprises a stack of wire elements. This adversely affects the thermal conduction in flow direction, which is beneficial to the extent of temperature drop across the additional regenerator.

A further favourable embodiment is characterized in that at least one of the at least one additional regenerator is also provided with a heat sink. Thus, an additional decrease in temperature can be attained by the dissipation of excess conveyed heat.

A further favourable embodiment is characterized in that the cooling element is provided with a heat sink mounted at a position before the displacer. The combination of heat flow-reduction means and heat sink allows an optimal temperature reduction on the warm side of the cooling element.

A further favourable embodiment is characterized in that the compressor is provided with a heat sink. This enables a substantial part of the compression heat to be dissipated at the compressor, which yields an additional decrease in temperature.

BRIEF DESCRIPTION OF THE DRAWINGS

The invention will now be explained in more detail with reference to the following figures, of which

DETAILED DESCRIPTION OF THE PREFERRED EMBODIMENTS

Figure 1:
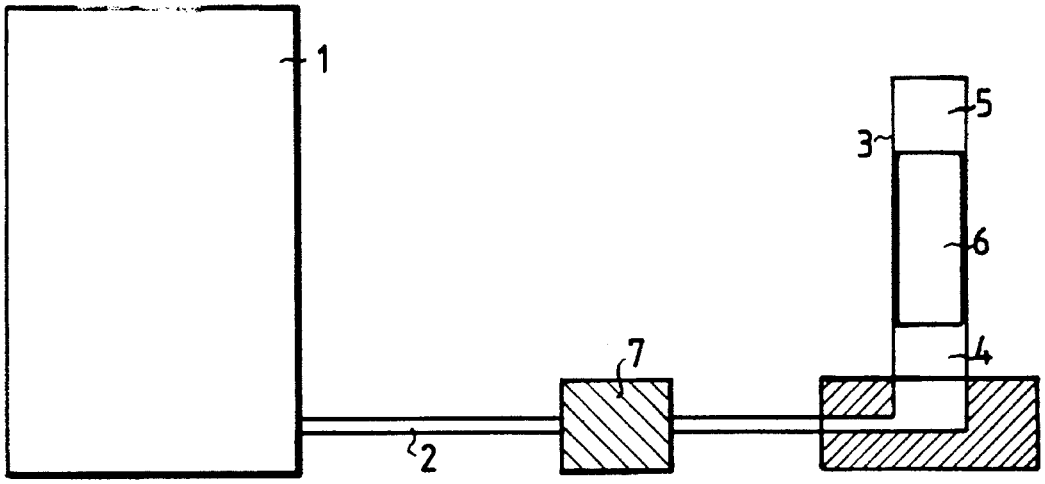
FIG. 1 represents a split cooler, based on the Stirling principle, provided with a compressor, a split tube and a cooling element implemented as a cold finger.

FIG. 1 individually distinguishes a compressor 1, a split tube 2 and a cooling element 3 implemented as a cold finger. During operation, a warm side 4 and a cold side 5 are induced in the cold finger, the latter side being capable of assuming an extremely low temperature (up to 50 K). These three elements combined constitute a hermetically sealed device, filled with gas acting as a cooling medium. In the present embodiment, Helium is used as cooling medium, since the passage of this gas into the liquid state occurs only at extremely low temperatures. For the proper functioning of the Stirling cooler in question, it is imperative that the medium constantly remains in a gaseous state. The use of other mediums can also be considered, on condition that the transition temperature to the liquid state is lower than the required cooling temperature. The compressor is designed as a linear compressor, although other compressor types, for instance rotary compressors, are also suitable. The compressor presented in FIG. 1 consists of two opposed pistons, moving in opposite directions, so that a low level of vibration is transmitted to the compressor housing. The compressor generates a periodically fluctuating pressure wave in the system. Per period the system completes a full closed Stirling cycle. The pressure wave is transmitted via the split tube 2 to the base, i.e. the warm side, of the cold finger. The displacer is actuated by the pressure fluctuations and the frictional force exerted by the gas flow on the displacer. The displacer also acts as first regenerator 6. Another possibility, however, is to design the displacer and first regenerator as separate units, as well-known in conventional Stirling devices, although said embodiment is preferred since it requires the least components. After some time, the tip of the cold finger assumes an extremely low temperature, since a quantity of heat is drawn from the tip to the base during each Stirling cycle. This causes the base to heat up, which heat has to be dissipated. The difference in temperature between the warm side and the cold side of the cold finger causes part of the heat to flow back to the cold side. This effect is detrimental to the effective available cooling power. In order to minimize this flow of heat, it is recommendable to construct the cold finger of a poor conductor material, for instance stainless steel. It is of importance to keep the temperature at the warm side of the cold finger as low as possible.

Another adverse effect occurring relates to the transport of heat from the compressor via the split tube 2 to the warm end of the cold finger, resulting in a positive temperature gradient from the compressor to the cold finger. This heat transport greatly contributes to the heating-up effect of the warm end of the cold finger, which contribution is usually many times greater than that of the heat transport from the cold side to the warm side of the cold finger. Qualitatively suitable heat-sinking provisions of the warm end of the cold finger are often difficult to realize. The cold finger will mostly form an integral part of an overall system, for instance an infrared camera. Moreover, heat sinking of the warm end of the cold finger constitutes a considerable problem from a design-engineering viewpoint. The substantial quantity of heat to be dissipated at the warm end of the cold finger only adds to this problem.

Figure 2:
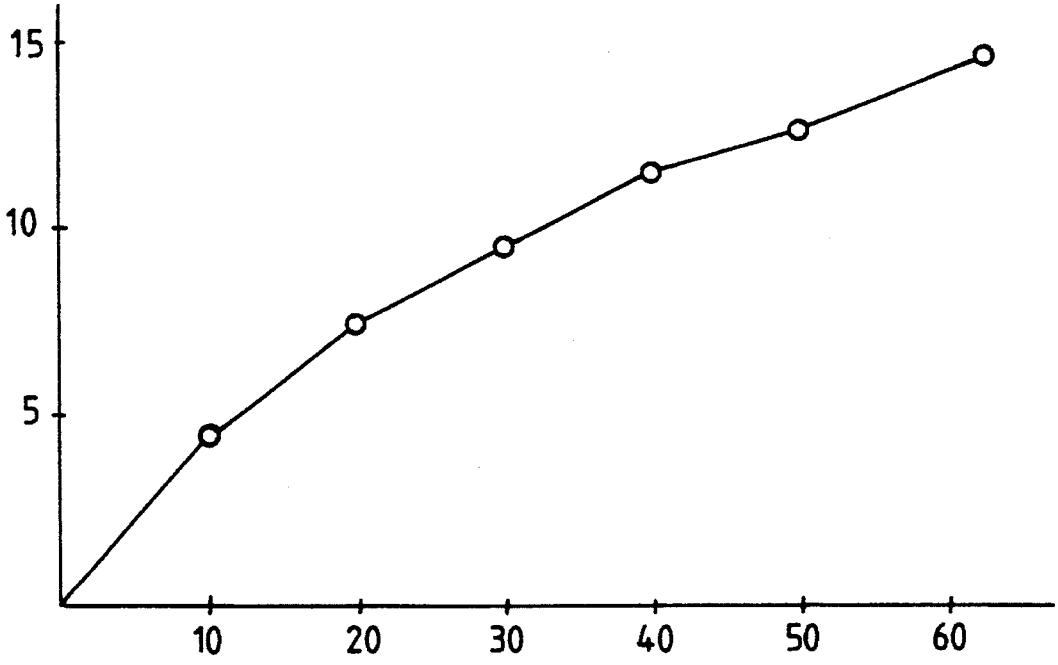
FIG. 2 represents a diagram of the heat to be dissipated at the warm end of the cold finger as a function of the compressor input power.

FIG. 2 shows a diagram of the heat dissipation in watts plotted on the vertical axis, from the warm end of the cold finger to the housing as a function of the power input to the compressor, expressed in watts and plotted on the horizontal axis. The experiments have been performed on a UP7050 cooler, developed by Hollandse Signaalapparaten B.V., branch office USFA at Eindhoven, at an ambient temperature of 20° C. The figure shows that the overall quantity of heat to be dissipated from the warm end of the cold finger approximately measures a third of the power input, whereas the generated cooling power is only in the order of magnitude of 1 watt, at a power input of 60 watts. The major part of the power to be dissipated is transferred from the compressor via the split tube to the warm end of the cold finger. A periodically fluctuating pressure applied to one side of a tube will generally cause the tube to heat up at the other side. This gives rise to a temperature gradient across the length of the tube. The intensity of the heat flow from the compressor to the cooling element is determined by the amplitude of the pressure fluctuation and the length and diameter of the tube. These effects are well-known.

The invention is based on the inventive principle that, instead of dissipating the heat at the tip of the cold finger, it is far more advantageous to reduce the heat flow from the compressor to the cold finger. This obviates the necessity for suitable heat sinking at the warm end of the cold finger and enhances the system's efficiency as a result of the reduction in temperature of the gas contained in the cold finger. The power to be supplied to compressor will consequently be reduced. According to a favourable embodiment of the invention, the reduction of the heat flow from the compressor the cold finger is realized by positioning an additional regenerator at a certain location between the compressor and the clearance under the displacer in the cold finger.

In the embodiment illustrated in FIG. 1, the additional regenerator 7 is positioned in the split tube between the compressor 1 and the cold finger 3. If possible, the additional regenerator 7 is preferably positioned in close proximity to the warm end of the cold finger, so that once beyond the additional regenerator 7, it is virtually impossible for the medium to gain heat. Another possibility is to employ several remotely-positioned additional regenerators. The regenerator preferably contains a substance having a large heat capacity and a large capacity for exchanging heat with the gas flowing through the regenerator. This enables the regenerator to draw the heat from the gas flowing through the regenerator and to give up this heat once the gas flows back again. In this way, the regenerator acts as a stop in the heat flow via the split tube to the warm end of the cold finger. As a result, the quantity of heat to be dissipated at the warm end of the cold finger is substantially smaller and its temperature will decrease considerably. This lower temperature will positively affect the system's efficiency. The heat that, without the incorporation of a regenerator, would have to be dissipated at the warm end of the cold finger is now to be dissipated at the compressor. It will usually be far easier to provide the compressor with a heat sink instead of with a cold finger.

Although not strictly necessary, it is extremely advantageous to incorporate the regenerator in an enlargement of the split tube, as shown in FIG. 1. The flow velocity of the medium will then be locally reduced, which to some extent compensates for additional resistance losses caused by the presence of the regenerator. The transition areas from the thinner to the thicker parts of the split tube should form a smooth blend in order to prevent local turbulence. The regenerator may consist of a stack of for instance several hundreds of wire elements that in longitudinal direction make contact in only a few positions. This optimally limits the thermal conduction in longitudinal direction. The wire elements shall preferably be constructed of a poor conductor material, such as stainless steel. Also other additional regenerator types may be considered, such as a large quantity of spherical elements, clippings or steel wool.

Figure 3:
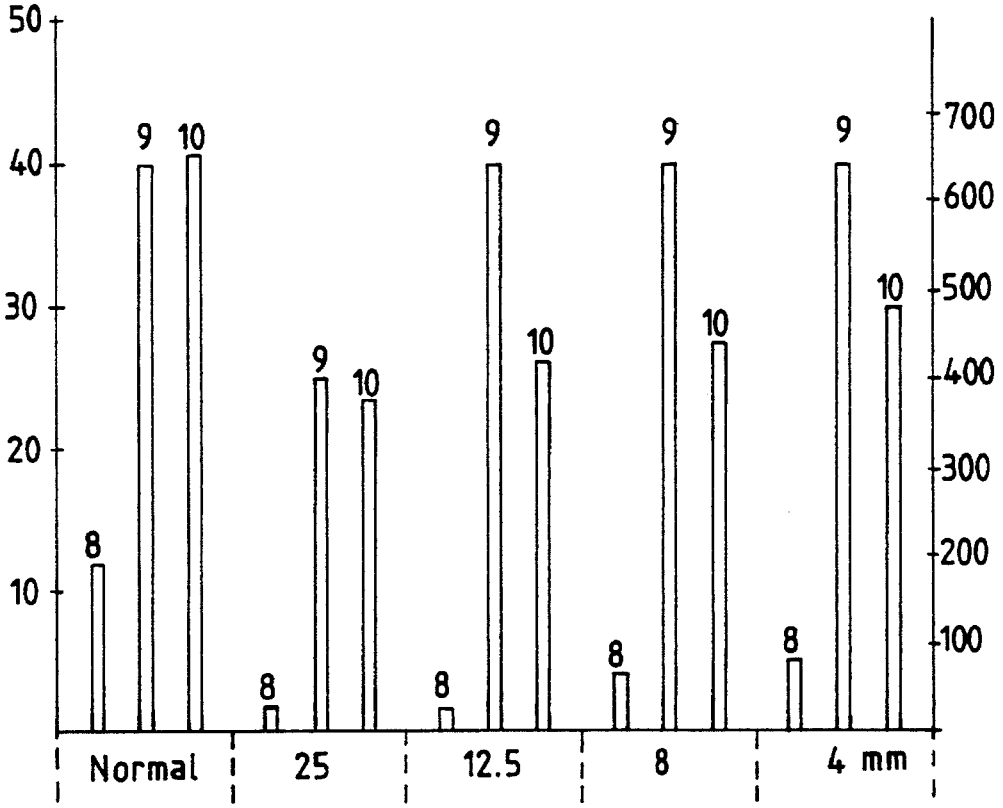
FIG. 3 represents in a histogram the measured final temperature at the warm end of the cooling element, the measured heat dissipation at the warm side of the cooling element and the measured nett effective available cooling power as a function of the regenerator length.

Experimental research has revealed the existence of optimum regenerator dimensions. An increase in regenerator length will generally result in an increased quantity of heat absorbed, consequently less heat will be transmitted. A drawback, however, is the increase in flow resistance. In view of this, it is required to design a regenerator that has the lowest flow resistance, but is all the same capable of absorbing heat to a sufficient extent. The experiments have been performed on said UP7050 cooler, developed by Hollandse Signaalapparaten B.V. branch office USFA at Eindhoven, at an ambient temperature of 20° C and a 40 W power input. FIG. 3 shows a histogram comprising the test results. In this histogram, $Q_{sink}$, indicated by the vertical bars 8, is equal to the quantity of heat that is generally dissipated via the heat sink. The value of $Q_{sink}$ in watts is plotted on the left-hand vertical axis. $T_1$, indicated by the vertical bars 9, represents the temperature on the warm side of the cold finger. The value of $T_1$ expressed in degrees Celsius can also be read on the left-hand vertical axis. $Q_e$, indicated by the vertical bars 10 represents the nett effective available cooling power. The value of $Q_e$ expressed in milliwatts is plotted on the right-hand vertical axis. The experiments have been performed without the additional regenerator denoted by Normal and at four different additional regenerator lengths, viz. 25 mm, 12.5 mm, 8 mm and 4 mm, which lengths are plotted on the horizontal axis. The following can be inferred from the figure:

1. The quantity of heat to be dissipated via the heat sink $Q_{sink}$ sharply declines as the regenerator length increases (from 12.5 down to 1.2 watt).
2. A length exceeding 12.5 mm does not yield improved results. A 12.5 mm regenerator is obviously capable of absorbing the total quantity of heat and of giving up this heat to the gas flowing through the regenerator.
3. Notwithstanding the presence of a regenerator, the cooling power remains more or less the same, provided that the regenerator is not too long (exceeding 12.5 mm).
4. The use of a smaller regenerator entails an increase of the heat $Q_{sink}$ to be dissipated at the warm end of the cold finger.

If no heat sink is applied at the warm end of the cold finger and if the heat flow-reduction means according to the invention are left out it is found that at an ambient temperature of 70° C., it is not possible to attain the required cooling temperature of 80 K at the cold end of the cold finger. This temperature could, however, be attained by the incorporation of an 12.5 mm additional regenerator in the split tube.

Figure 4:
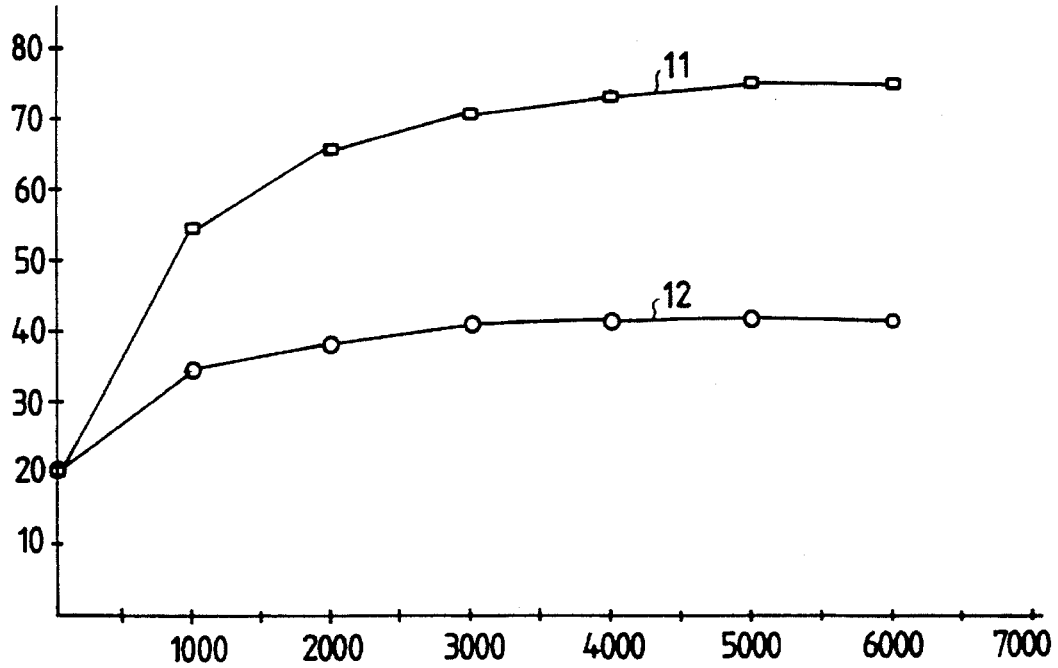
FIG. 4 represents the temperature gradient of the warm end of the cooling element after cooler start-up both without and with the incorporation of the additional regenerator according to the invention.

FIG. 4 diagrammatically represents the effect of the additional regenerator incorporated in the split tube on the temperature gradient of the warm side of the cold finger after system start-up. The time t expressed in seconds is plotted on the horizontal axis and the temperature T expressed in degrees Celsius is plotted on the vertical axis. The measurements have been performed without a heat sink at the warm end of the cold finger. Curve 11 represents the temperature gradient without the incorporation of an additional regenerator and curve 12 represents the temperature gradient with the incorporation of an additional regenerator. The diagram shows that the final temperature with the incorporation of an additional regenerator is considerably lower than without the incorporation of an additional regenerator.

Figure 5:
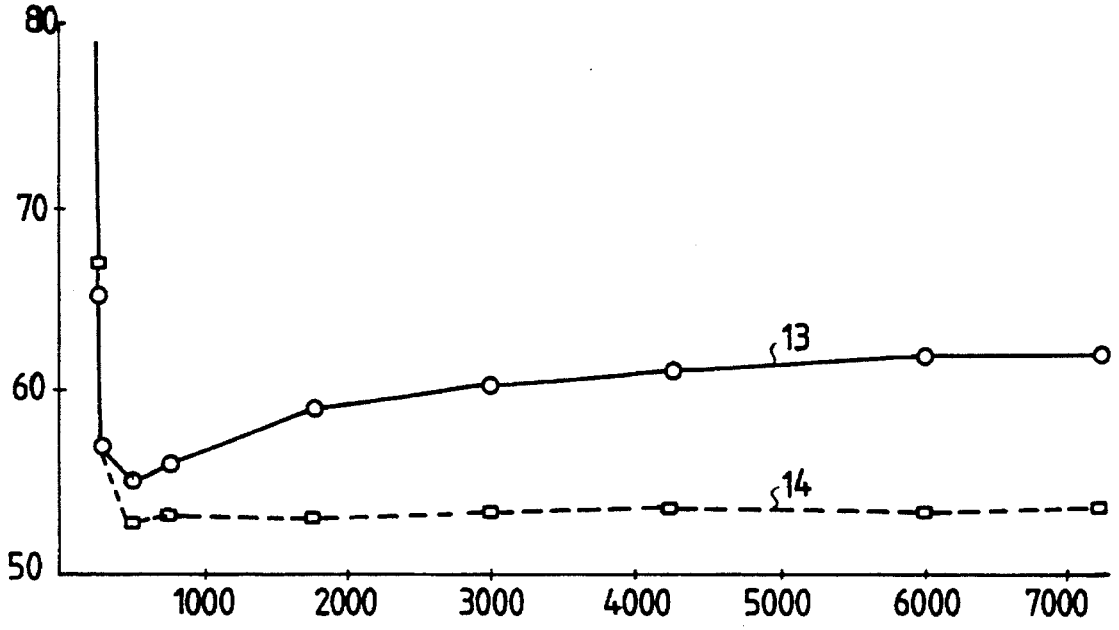
FIG. 5 represents the temperature gradient of the cold end of the cooling element after cooler start-up both without and with the incorporation of the additional regenerator according to the invention and without the incorporation of a heat sink at the warm end of the cooling element.

FIG. 5 diagrammatically represents the effect of an additional regenerator incorporated in the split tube on the temperature gradient at the cold side of the cold finger after system start-up. The time t in seconds is plotted on the horizontal axis and the temperature T in degrees Celsius is plotted on the vertical axis. The measurements were once again conducted without a heat sink at the warm end of the cold finger. Curve 13 represents the temperature gradient without additional regenerator and curve 14 with additional regenerator. It can be seen that the final temperature to be attained at the cold end of the cold finger is considerably lower with the presence of an additional regenerator.

The use of heat-suppressive means implemented as an additional regenerator between the compressor and the displacer yields the following advantages:

1. The required heat dissipation at the warm end of the cold finger is sharply reduced, as a result of which heat-sinking becomes less important or will even be no longer required.
2. The heat-suppressive means can be designed such that the cooling power will not decrease at normal ambient temperatures, while a considerable gain in cooling power can be effected at higher ambient temperatures.
3. The range of application of a linear cooler is noticeably extended.

Figure 6:
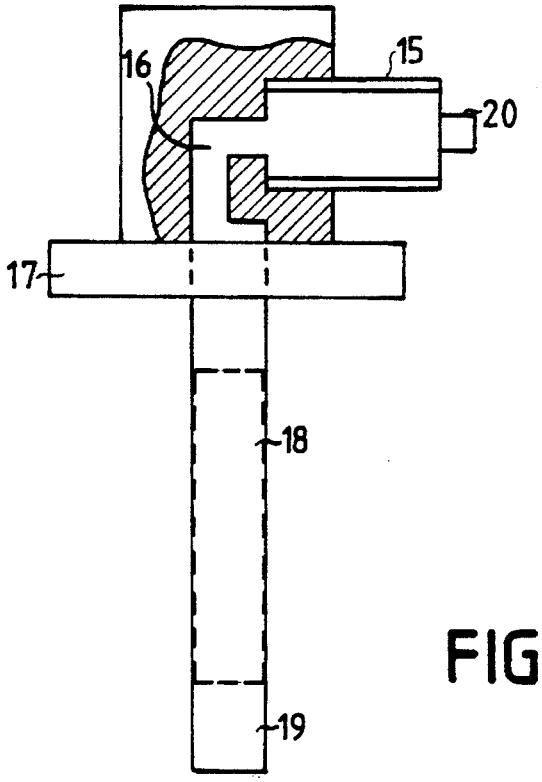
FIG. 6 represents a cooling element implemented as a cold finger, which is provided with an additional regenerator incorporated in the warm end of the cooling element.

FIG. 6 shows the integration of an additional regenerator 15 in the warm side 16 of the cooling element 17. The cooling element again comprises a combined displacer and regenerator 18, although it is also possible to implement these as two separate elements. The space 19 becomes extremely cold during operation. A split tube can be attached to side 20, for instance by means of a welded joint. The advantages attached to the integration of the additional regenerator in the warm side of the cooling element are that, once beyond the regenerator, the medium cannot possibly regain heat and a compact integrated unit is obtained.

It will be evident that the use of an additional regenerator between the compressor and the displacer is by no means confined to the embodiment comprising a cold finger, provided with one displacer and one regenerator, whether or not combined. The invention is suitable for every type of Stirling cooler, the cooling element of which is positioned at a certain distance from the corresponding compressor, which components are connected together by a connecting line.

I claim:

1. A stirling cooler, comprising:

a compressor for generating a time-varying pressure in a gaseous medium;

a cooling element which is not mounted on the compressor, the cooling element being provided with at least a displacer and at least a regenerator;

a split tube which connects the compressor with the cooling element;

wherein at least one additional regenerator is mounted in an enlargement of the split tube.

2. The stirling cooler as claimed in claim 1, wherein at least one of the at least one additional regenerators comprises a stack of wire elements.

3. The stirling cooler as claimed in claim 1, wherein at least one of the at least one additional regenerators is also provided with a heat sink.

4. The stirling cooler as claimed in claim 1, wherein the compressor is provided with a heat sink.

5. The stirling cooler as claimed in claim 1, wherein the cooling element is provided with a heat sink mounted at a position before the displacer.

* * * * *